US005595230A

United States Patent [19]

Guerra

[11] Patent Number: 5,595,230

[45] Date of Patent: Jan. 21, 1997

[54] CRIME SCENE BODY SHIELD

[76] Inventor: Art Guerra, 13723 Faust Ave., Bellflower, Calif. 90706

[21] Appl. No.: 509,175

[22] Filed: Jul. 31, 1995

[51] Int. Cl.[6] ..... A47G 5/00

[52] U.S. Cl. ..... 160/135; 135/900; 135/902; 256/1; 256/25; 160/237; 160/352

[58] Field of Search ..... 160/135, 351, 160/237, 352, 405; 135/900, 901, 902; 256/1, 24, 25, DIG. 2

[56] References Cited

U.S. PATENT DOCUMENTS

| | | | |
|---|---|---|---|
| 2,024,090 | 12/1935 | Cadmus | 160/237 X |
| 2,517,386 | 8/1950 | Cooper | 256/25 |
| 2,895,717 | 7/1959 | De Falco | 256/25 |
| 3,537,688 | 11/1970 | Stein | 256/24 |
| 4,373,570 | 2/1983 | Nussdorf et al. | 160/351 X |
| 4,685,484 | 8/1987 | Moneta | 160/351 X |
| 4,966,181 | 10/1990 | Liberman et al. | 135/902 X |
| 4,969,500 | 11/1990 | Makosa | 160/135 |
| 5,207,260 | 5/1993 | Commesso | 160/135 |
| 5,402,999 | 4/1995 | Keehn | 160/135 X |

*Primary Examiner*—David M. Purol
*Attorney, Agent, or Firm*—Charles H. Thomas

[57] ABSTRACT

An apparatus for visually shielding a corpse from view at a crime scene includes a plurality of free-standing shroud support stands and a plurality of rectangular shroud panels of flexible, opaque sheet material. Each shroud support stand is formed with at least one upright post for supporting the shroud panels in a vertical disposition. The shroud support stands are placed at appropriate locations about the body of a deceased person at a crime or accident scene. The shroud support panels are strung from one post to the next to form a vertical, enclosing barrier that visually shields the body from view by spectators in the vicinity of the crime or accident scene. By visually shielding the body from view, police personnel are able to reduce spectator anxiety and the likelihood of emotional outbursts and disturbances among spectators while awaiting the arrival of personnel from the coroner's office.

3 Claims, 4 Drawing Sheets

CRIME SCENE BODY SHIELD

BACKGROUND OF THE INVENTION

1. Field of the Invention

The present invention is directed to a method and apparatus for visually shielding a corpse from view at a scene of police action.

2. Description of the Prior Art

When there is a fatality during the course of commission of a crime standard police operating procedure requires the police officers who arrive early on the scene to secure the crime scene without disturbing any evidence. This normally involves establishing a perimeter at least thirty feet from the site of possible evidence. This perimeter is normally established by laterally extending yellow tape about upright supports in the vicinity to provide a clear demarcation of the secured area. The first police officers on the scene are also charged with the responsibility for preventing unauthorized personnel from entering the restricted area once that area has been established. The only personnel authorized to enter this area will normally be crime investigating officers and personnel from the county coroner's office.

When a fatality has occurred during the course of a suspected crime, very frequently important evidence relative to the crime may be obtained through a competent examination of the body of the deceased person or persons. However, any disturbance of the body or the area immediately surrounding the body is very likely to destroy or contaminate important evidence. Therefore, after having initially determined that the deceased person is, in fact, dead and that there is no hope of resuscitation, proper police practice requires the police officers on the scene to ensure that the body of the deceased remains undisturbed in the position in which it is found. The body is only removed following an investigation of the crime scene by personnel from the coroner's office.

Due to the distance from a crime scene, increased work load necessitated by budget constraints, and traffic conditions in urban areas, six, eight, or even more hours often elapse from the time a body is discovered at a crime scene until the arrival of personnel from the coroner's office. During this time the body of the deceased should remain in the position and condition in which it was found, undisturbed, so as to preserve evidence that may be discovered by an examination of the body and its immediate surroundings. As a result, the body of a deceased person at a crime scene is often left to lie in full view from beyond the secured perimeter of the crime scene for many hours.

Since police action at the scene of a suspected crime is usually highly visible and often involves a considerable commotion, very frequently a crowd of spectators will gather about the perimeter of the secured area and attempt to ascertain the cause of the excitement. Quite often the mood of many of the spectators is highly emotional, particularly among those spectators who may have witnessed events relating to the suspected crime or who are familiar with the individuals that were involved in the events leading to the fatality. Indeed, some of the spectators may have known the deceased individual or individuals personally. Furthermore, family members of the deceased individuals are often present or are called to the scene of the suspected crime.

The appearance of the corpse of a family member or friend lying dead in full view for a lengthy period of time is frequently very emotionally disturbing to many of the spectators. Moreover, the high emotional intensity that may be present among the spectators often makes it difficult for the police officers on the scene to maintain the crime scene in a secured condition. Indeed, the high emotional level of those in the vicinity of the secured crime scene may put others in the immediate area into jeopardy, including those police personnel present at the crime scene.

The emotional distress and anguish of friends or relatives of a deceased person may be substantially heightened where visible indications of pain or suffering of the decedent prior to expiration are evident. Such visible indications include visible mortal wounds, heavy blood loss, or an unnatural condition of the body, such as partial or complete disrobement. Furthermore, such conditions also tend to attract a large number of curiosity seekers, thus amplifying the problems of maintaining security about the crime scene.

In the past it has not been unusual for police officers on the scene of a suspected crime to attempt to reduce the level of spectator anxiety, emotion, and attention by covering the body of the decedent so as to shield it from public view. For example, blankets, sheets, and plastic tarpaulins have often been spread over the body while awaiting the arrival of coroner personnel. While such a manner of concealment does serve to alleviate emotions among spectators and reduce the problems of maintaining security at the crime scene to police officers on the site, such a conventional practice of concealment has decided disadvantages. Specifically, if a body of a deceased person at a crime scene is covered, for example, with a blanket, the fibers from the blanket may be transferred to the body of the deceased. Also, when a covering that has been placed directly on top of the body of a deceased person is removed, it may carry away with it important evidence, such as particles of dust, hair, and other tiny but important evidentiary material.

A further problem involved in the conventional techniques of covering a body at the scene of a crime is that a covering placed atop the body tends to alter the temperature of the corpse. The imposition of such a covering disrupts and distorts the temperature of the corpse, thus making the time of death more difficult to establish and also often hastening the decomposition process. This likewise can lead to important tainting, degradation, or complete loss of evidence.

SUMMARY OF THE INVENTION

The present invention involves a system for use by police personnel which allows a body of a deceased person at the scene of a possible crime or accident to be visually shielded from the view of spectators around the crime scene while awaiting the arrival of investigatory and coroner personnel. This visual shielding is accomplished without any significant likelihood of contamination or loss of evidence. Furthermore, the visual shielding system of the invention does not involve any direct contact of any shrouding material with either the body or the clothing of the deceased. Thus, there is no likelihood of transfer of material, such as fabric fibers, dust, dirt, greases, or oils from the shrouding material to the body to be visually shielded using the system of the present invention.

A further object of the invention is to visually shield a corpse from view at the scene of a police action without affecting the temperature of the corpse. The shielding system of the invention does not involve placing any covering atop the corpse. To the contrary, visual shielding is achieved by erecting a temporary, generally vertical, visual barrier about the corpse. This visual barrier does not contact the corpse in any way, and therefore avoids affecting the temperature of the corpse.

As the result the practice of the invention, emotional tensions among spectators in the vicinity of the scene of police action at which a fatality has occurred are significantly alleviated. Furthermore, this is achieved without introducing any source of evidentiary contamination and without altering the temperature of the body.

In one broad aspect the present invention may be considered to be an apparatus for visually shielding a body from view at a scene of police action. The apparatus is comprised of a plurality of free-standing shroud support stands each having a base and at least one post extending upright from the base. The apparatus also includes a plurality of flexible, opaque, rectangular shroud panels and means for releasably fastening the shroud panels to the posts. The support stands and the shroud panels are assembled together with the support stands disposed at laterally spaced intervals about the body. The shroud panels are releasably fastened to the posts of laterally adjacent ones of the shroud support stands so as to extend therebetween.

Preferably the bases of the shroud support stands are weighted to enhance their stability. Also, at least some of the shroud panels are preferably perforated with vent slits. Such slits allow air circulation to occur in the proximity of the body so as to further prevent the apparatus of the invention from affecting the temperature of the body.

In another broad aspect the invention may be considered to be a method of visually shielding a body from view at the scene of police action utilizing a plurality of support stands each having a free-standing base and at least one shroud support projecting upwardly from the base, and a plurality of rectangular shroud panels formed of flexible, opaque sheet material each having mutually parallel side edges and mutually parallel top and bottom edges. According to the invention the shroud support stands are positioned about the body at laterally spaced intervals. Each of the shroud panels is mounted on the shroud stands by fastening the side edges of each shroud panel onto the shroud supports on each of two laterally adjacent shroud support stands. Preferably the laterally spaced intervals between the shroud support stands are increased after fastening the shroud panel sides onto the shroud supports to thereby hold the shroud panels taut between the shroud stands.

The invention may be described with greater clarity and particularity by reference to the accompanying drawings.

DESCRIPTION OF THE EMBODIMENT AND IMPLEMENTATION OF THE METHOD

Figure 1:
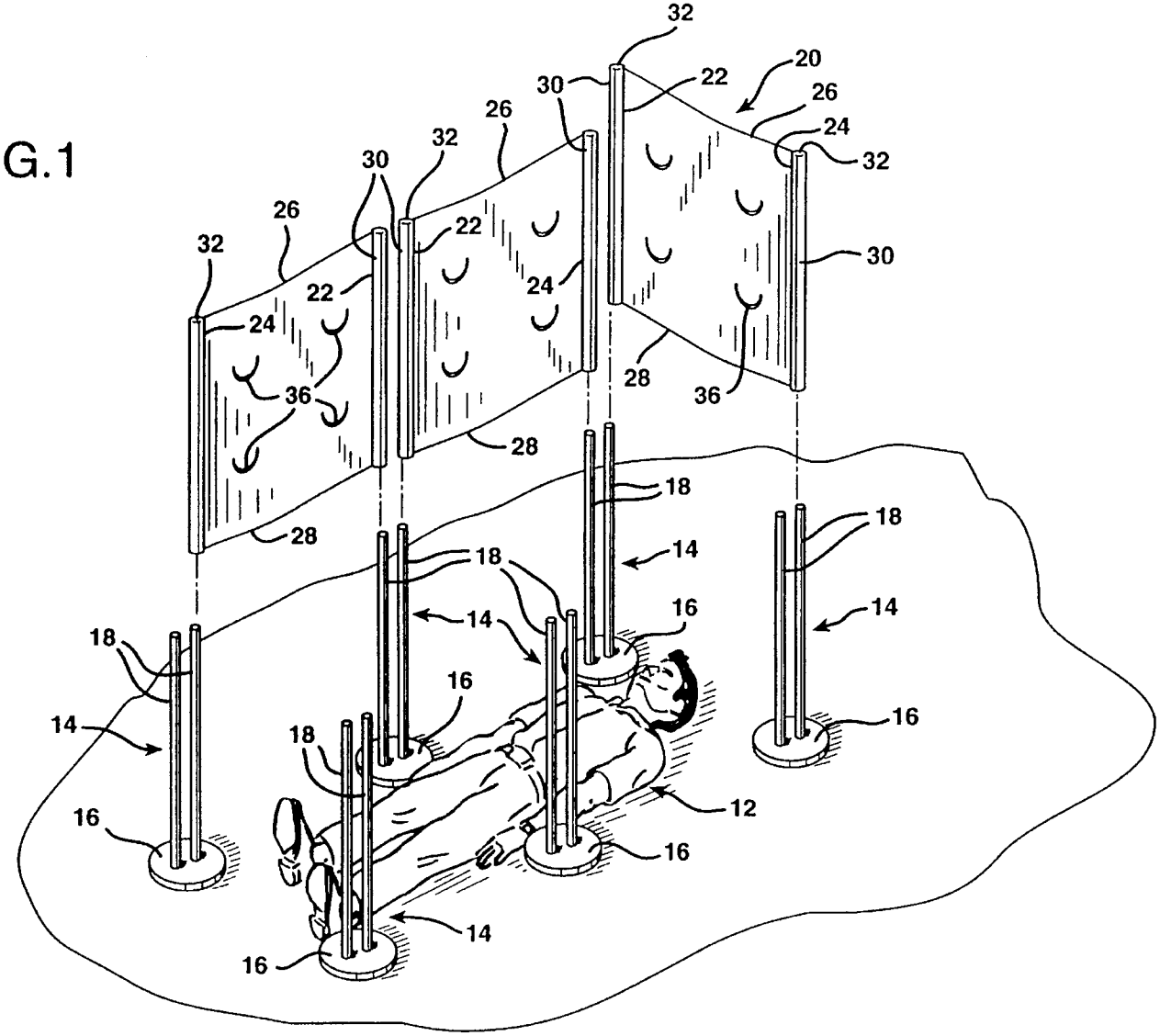
FIG. 1 is a perspective view illustrating the components of the apparatus of the invention and their manner of interconnection to visually shield a body from view at a scene of police action.
Figure 2:
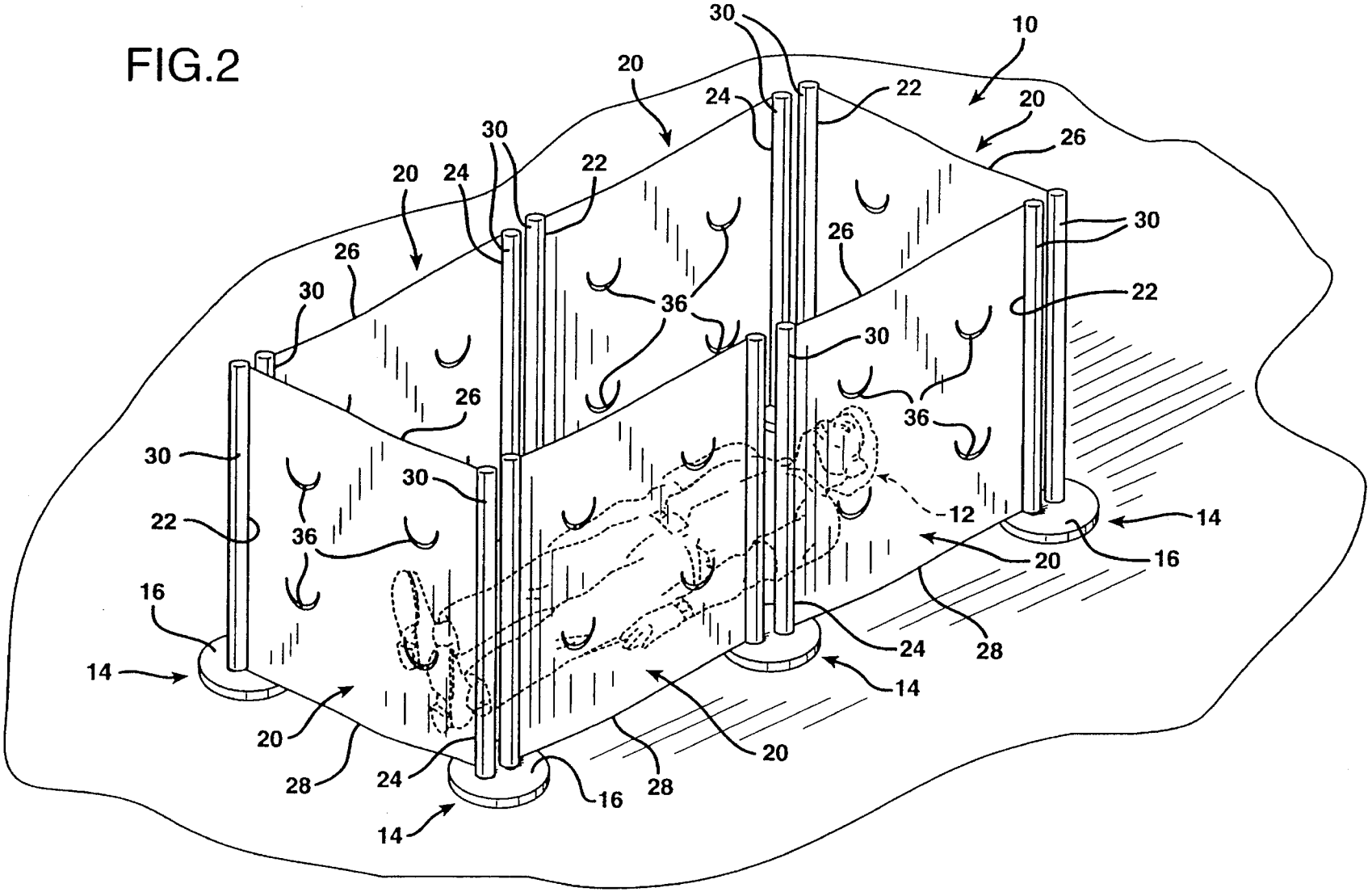
FIG. 2 is a perspective view illustrating the apparatus of the invention in a fully assembled condition.
Figure 3:
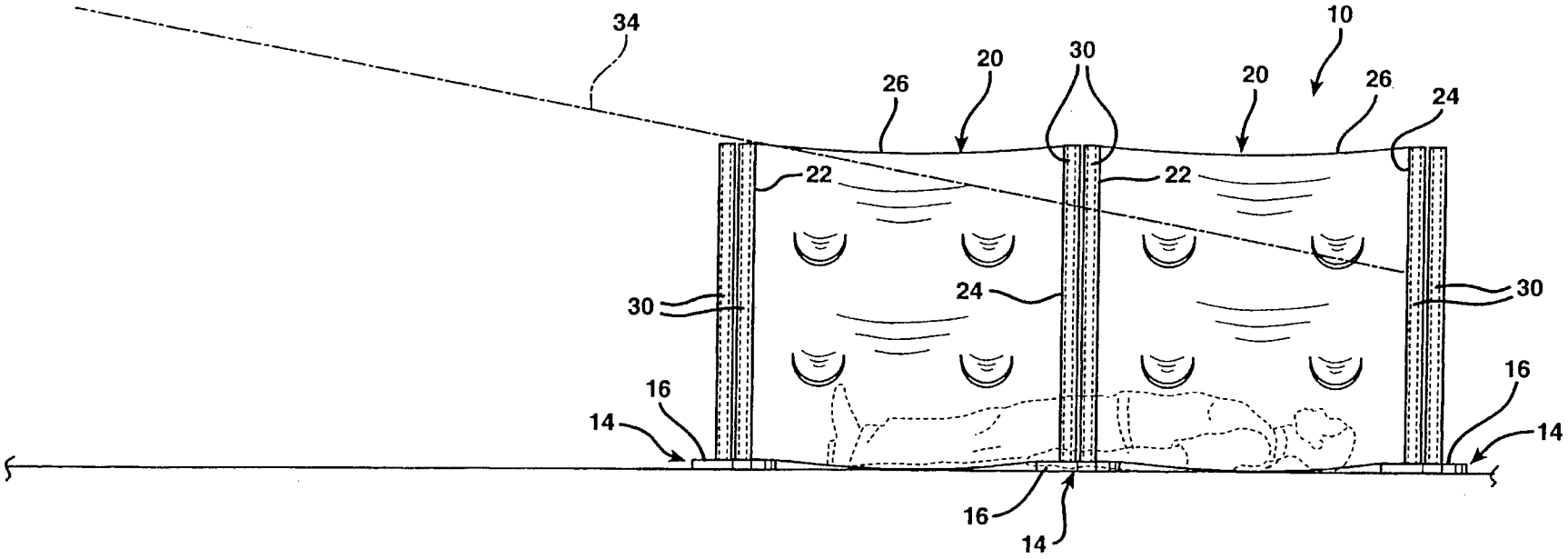
FIG. 3 is a side elevational view of the apparatus of FIG. 2.

FIGS. 2 and 3 illustrate a visual concealment apparatus indicated generally at 10 for visually shielding a corpse 12, shown in phantom in FIGS. 2 and 3 and in solid lines in FIG. 1. The apparatus 10 shields the corpse 12 from the view of spectators standing about the perimeter of a scene of police action, such as a crime scene, once the area has been secured by police officers on the scene.

As best shown in FIG. 1, the apparatus 10 is comprised of a plurality of free-standing shroud support stands 14 each having a generally disc-shaped base 16 formed of a weighted material to enhance stability, such as heavy rubber. Each shroud support stand 14 also includes at least one upright shroud support post 18. In the preferred embodiment illustrated in the drawings each shroud support stand 14 includes a pair of mutually parallel, generally tubular shroud support posts or poles 18. The disc-shaped base 16 is preferably about ten inches in diameter. The tubular shroud support posts 18 extend upwardly from the base 16 a distance of between eighteen and twenty-four inches. The posts 18 may be formed of hollow aluminum or polyvinyl chloride plastic tubing, for example. The posts 18 are spaced closely together and are typically no more than about two inches from each other.

The visual concealment apparatus 10 is also comprised of a plurality of rectangular shroud panels 20. Each shroud panel 20 is formed from a flexible, opaque sheet of material 40, shown in FIGS. 4 and 5 which may, for example, be a plastic sheet of polyvinyl chloride or polyethylene between about one mil and ten mils in thickness. Each shroud panel 20 has a rectangular expanse bounded by mutually parallel side edges 22 and 24 and mutually parallel top and bottom edges 26 and 28, respectively.

A means is provided for releasably fastening the shroud panels 20 to the posts 18. In the preferred embodiment this releasable fastening means is provided by a pair of sleeves 30 formed along both of the side edges 22 and 24 of each of the shroud panels 20. The sleeves 30 are closed at their tops 32 at the top edge 26 of each panel 20, and open at their opposite ends.

As illustrated in FIGS. 1 and 2, the shroud support stands 14 and shroud support panels 20 are assembled together so that the support stands 14 are disposed at laterally separated locations about the corpse 12 at spaced intervals from each other. The shroud panels 20 are each releasably fastened to the posts 18 of laterally adjacent ones of the shroud support stands 14 so as to extend therebetween in a generally vertical orientation. As best shown in FIG. 1, each of the shroud panels 20 is mounted to extend between two laterally adjacent shroud support stands 14. The shroud support posts 18 of each shroud support stand 14 extend upwardly into the sleeves 30 of each of two different, mutually adjacent shroud panels 20.

As illustrated, since each shroud support stand 14 has a pair of upright post 18 closely spaced relative to each other, the proximately located sleeves 30 of two adjacent shroud panels 20 are disposed side-by-side, mounted respectively on the two upright shroud support posts 18 of a common shroud support stand 14. The proximately located sleeves 30 of adjacent shroud panels 20 are thereby separated from each other by only a short distance, typically no more than an inch or two at the very most.

The rectangular expanse of each of the shroud panels 20 is preferably between about thirty and thirty-six inches between the side edges 22 and 24 thereof, and between about eighteen and twenty-four inches between the top and bottom edges 26 and 28 thereof. Thus, the shroud support stands 14 are typically initially positioned apart from each other a distance slightly less than the thirty to thirty-six inch width of the panels 20. This allows an officer at the scene to easily slide the sleeves 30 of the shroud panels 20 down onto the upright shroud support posts 18 in the manner illustrated in FIG. 1.

The shroud support stands 14 are spaced from the body 12 at appropriate distances relative thereto so that when the installation of the shroud panels 20 on the shroud support stands 14 is complete, as depicted in FIGS. 2 and 3, the body 12 is to a very large extent shielded from view. As shown in FIG. 3, an observer from even an elevated location, such as from a window of a lower story of a building in the vicinity, will still be unable to see the corpse 12. A view of the corpse 12 by a spectator looking along a line of sight indicated at 34 for example, will be totally blocked. The visual concealment apparatus 10 formed by the assembled shroud panels 20 and shroud support stands 14 provides complete visual shielding from the lines of sight available to most spectators in the vicinity outside of the secured perimeter of the crime scene.

While it could be possible to place a further sheet of material across the tops of the support posts 18 so as to provide total visual shielding of the body even from the upper floors of surrounding buildings, it is inadvisable to provide the apparatus 10 with such a roof. Such a structure would influence the body temperature of the corpse 12, thus impeding the investigation and altering the condition of the body 12.

It should be noted that no portion of the visual concealment apparatus 10 contacts the corpse 12. Thus, there is no opportunity for transfer of any materials between the corpse 12 and either the shroud panels 20 or the shroud support stands 14. The visual shrouding apparatus 10 therefore does not present a source of evidentiary contamination.

The number of shroud panels 20 and shroud support stands 14 that are employed will vary, depending upon the position of the body 12, the orientation of the limbs relative to the torso, and other articles or material in the immediately vicinity of the body 12 which should not be disturbed, such as blood, clothing, weapons, briefcases, and other objects and substances that may be strewn about the crime scene. The number of shroud support stands 14 to be deployed at the scene will also vary, depending upon the amount of space available between the corpse 12 and any adjacent structures, such as buildings and vehicles, and other characteristics of the crime scene. However, since each of the shroud support stands 14 is free standing, it can be moved about as appropriate so that together the shroud support stands 14 either completely surround the body 12, or surround a portion of the body 12 if the body 12 is otherwise concealed from view by some other structure, such as a building wall, shrubbery, or a vehicle, for example.

Typically at least six shroud support stands 14 and six shroud panels 20 are employed to completely surround an adult human corpse 12 in the manner illustrated in the drawing figures. Naturally, fewer shroud support stands 14 and fewer panels 20 are required to visually shield the body of a child from view or to provide a visual shield if the body 12 is concealed from one or more sides by buildings, vehicles, or the like. On the other hand, a greater number of shroud panels 20 and shroud support stands 14 may be required to visually shield two or more bodies closely spaced together or a body in which the limbs are extended laterally from the torso.

Preferably at least some of the shroud support panels 20 are provided with vent openings 36 therein so as to allow air circulation in the vicinity of the body 12, but without exposing the body 12 to view. The vent openings 36 may take the form of crescent-shaped slits in the sheet material forming the shroud panels 20, as illustrated.

The shroud support stands 14 are of a size and shape such that they can be gathered together following removal of the body 12 from the crime scene and stored in the trunk of a squad car or police van. The shroud panels 20 are preferably disposable in nature.

Figure 4:
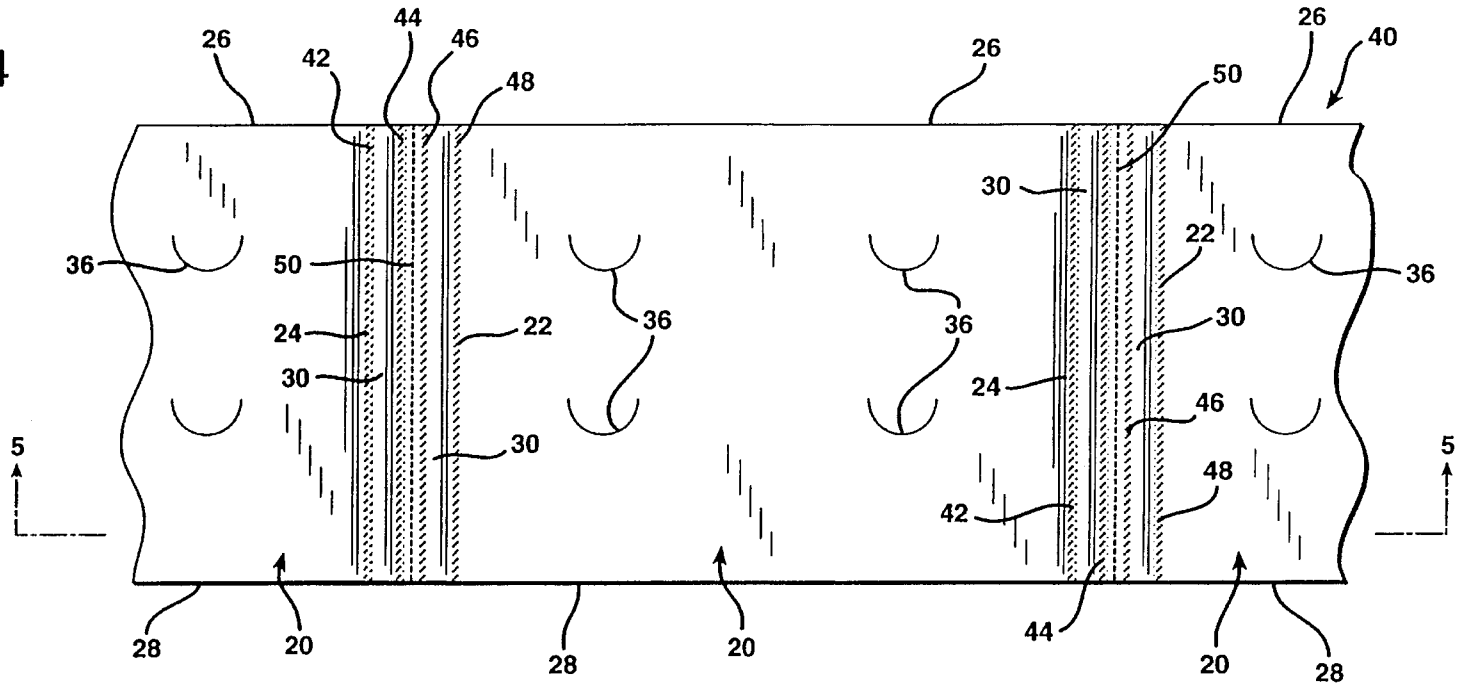
FIG. 4 is a plan view of a portion of a length of sheet material used to form the shroud panels of the invention.
Figure 5:
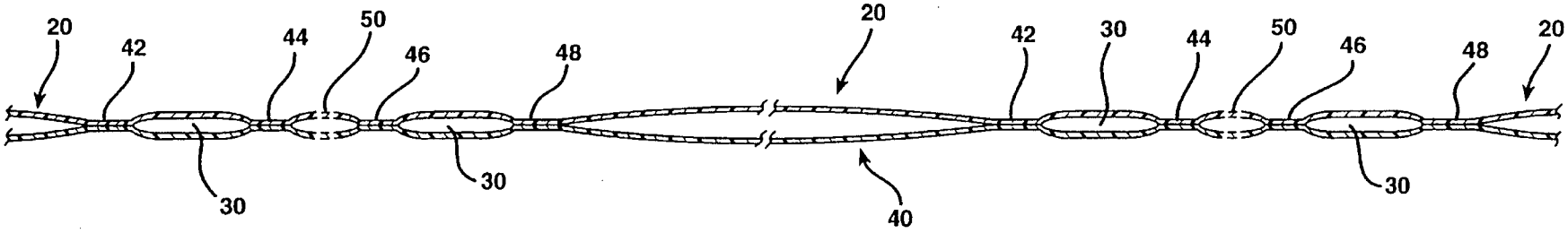
FIG. 5 is a sectional view taken along the lines 5—5 of FIG. 4.

The shroud panels 20 may be fabricated from a double thickness of sheet material 40 folded in half lengthwise to define the top edge 26 of each shroud panel. A section of the length of the folded sheet 40 is illustrated in FIGS. 4 and 5. After fabrication of the shroud panels 20, the sheet 40 is preferably wound into a roll for ease of transportation. The sheet 40 is formed of a cheap, disposable, plastic material. The roll of shroud panels 20 can thereby easily be carried in the trunk of a squad car or other police vehicle.

To fabricate the shroud panels 30, the two juxtaposed layers of the sheet material 40 are heat sealed together transversely across the width of the folded sheet 40 at regularly space intervals. The lines of heat sealing are indicated at 42, 44, 46, and 48. This pattern of heat sealing lines is repeated at regular intervals along the length of the folded sheet 40 to define the rectangular shapes of the shroud panels 20 between each set of heat seal lines. The structure of the two layers of the sheet material 40 is fused along the heat seal lines 42, 44, 46, and 48.

The heat seal lines are arranged in pairs. That is, the heat seal lines 42 and 44 form a first pair while the heat seal lines 46 and 48 form a second pair in every repeated pattern, as illustrated in FIGS. 4 and 5. The spacing between the heat seal lines 42 and 44 is the same as the spacing between the heat seal lines 46 and 48. This spacing is relatively close together. For example, heat seal line 44 may be spaced three inches from heat seal line 42 and heat seal line 48 may likewise be spaced three inches from heat seal line 46. With this spacing the first pair of heat seal lines 42 and 44 and the second pair of heat seal lines 46 and 48 form the structure of the sleeves 30 at the proximate ends of adjacent panels 20. That is, the heat seal line 42 forms one vertical side edge 24 of one shroud panel 20 while the heat seal line 48 forms the opposite side edge 22 of the next adjacent shroud panel 20.

A line of perforations 50 is formed across the width of the sheet of material 40, through both of the thicknesses thereof, midway between the adjacent heat seal lines 44 and 46 in each repetitive pattern of heat seal lines. The lines of perforations 50 allow each shroud panel 20 to be separated from the remainder of a length of sheet material 40 by tearing the material 40 along the line of perforations 50 as a length of the sheet material 40 long enough to define each shroud panel 20 is withdrawn from the roll of sheet material 40. Thus, in some instances this facilitates manipulation of the shroud panels 20 by allowing the officer at the scene to completely separate the shroud panels 40 from each other and to install each shroud panel 20 separately as illustrated in FIG. 1.

To assemble the apparatus 10, the shroud support stands 14 are first placed at the approximate positions at which they should be located within the secured crime scene so as to support the shroud panels 20 in order to visually conceal the body 12 from all sides. The typical placement of shroud support stands 12 is depicted in FIG. 1. Once the shroud support stands 12 are in position, the officers in charge proceed to install the shroud panels 20 on the shroud support stands 14. The requisite number of shroud panels 20 are withdrawn from the roll of sheet material 40. Each shroud panel 20 may be torn separately along the line of perforations 50 behind it on the rolled sheet 40 and individually placed onto the shroud support stands 14 as depicted in FIG. 1.

To install the shroud panels 20 on the shroud support stands 14, a police officer at the scene holds a shroud panel 20 above the level of the shroud support posts 18 of two different shroud supports stands 14 so that the sleeves 30 of each shroud panel 20 are approximately vertically aligned with upright shroud support posts 18 of each of two different adjacent shroud support stands 14. Each shroud panel 20 is then lowered into position by sliding the sleeves 30 thereof downwardly onto one of the upright support posts 18 of each of two adjacent shroud support stands 14 so that the rectangular expanse of the shroud panel 20 spans the distance therebetween.

The shroud panels 20 are sequentially installed, side by side, so as to surround the body 12 as depicted in FIGS. 2 and 3. Preferably, once all of the shroud panels 20 have been installed on the shroud supports stands 18, the bases 16 of the shroud support stands 14 are pulled away from each other so as to increase the laterally spaced intervals between the shroud support stands 14 as much as possible. This places lateral tension on each of the shroud panels 20 between its opposing side edges 22 and 24 so as to hold each of the shroud panels 20 taut between the shroud support stands 14 to which they are fastened. The lateral tension thus provided prevents the flexible material of the panels 20 from sagging between the shroud support posts 18 of the adjacent shroud support stands 14.

In an alternative manner of installation, the shroud panels 20 to be installed are not separated from each other. Preferably, the heat seal lines 44 and 46 are located a distance apart only slightly greater than the distance between the upright shroud support posts 18 on each of the shroud support stands 14. This facilitates sliding the adjacent sleeves 30 of mutually adjacent shroud panels 20 onto the upright shroud support posts 18 of a single shroud support stand 14 without necessarily having to separate the longitudinal lengths of the material 40 to form the shroud panels 20 as completely separated structures.

In this alternative manner of installation, a length of the sheet material 40 long enough to define the requisite number of shroud support panels 20 can be withdrawn from the roll of sheet material 40. This length can be separated from the remainder of the roll by merely tearing the length withdrawn from the remainder of the roll along the appropriate transverse perforation line 50. The plurality of shroud panels 20 withdrawn can thereupon be serially connected together, rather than torn off individually in the manner previously described.

Since the distance between the heat seal lines 44 and 46 is slightly greater than the distance between the two shroud support posts 18 on each of the shroud support stands 14, the sleeve 30 of one shroud support panel 20 at the side edge 24 thereof and the sleeve 30 of the next adjacent shroud panel 20 at the side edge 22 thereof can be inserted together onto the two shroud support posts 18 of the same shroud support stand 14. The installing officer can slide both adjacent sleeves 30 down toward the base 16 from which they project without separating the adjacent shroud support panels 20 from each other along the perforation line 50. The only separations that are required will be at the extreme ends of the length of the sheet 40 withdrawn delineating the first and last shroud panels 20 drawn off of the roll of material 40.

When all of the shroud panels 20 have been installed using either technique, the assembly of the concealment apparatus 10 is complete. When the shroud panels 20 are installed on the shroud support stands 14 so as to surround the corpse 12 as depicted in FIGS. 2 and 3, the corpse 12 is visually shielded from spectators viewing the activity at the secured perimeter of the crime scene. The apparatus 10 forms a temporary vertical viewing barrier. Once the personnel from the coroner's office have removed the corpse 12, the shroud panels 20 are removed from the shroud support stands 14 and discarded. The shroud support stands 14, on the other hand, are stored in the trunk of the squad car or homicide investigator's car for future use.

Undoubtedly, numerous variations and modifications of the invention are possible. For example, the fastening means employed to secure the shroud panels 20 to the shroud support stands 14 could be altered, as could the structure of the shroud support stands 14 themselves. For example, each shroud support stand might be equipped with but a single cylindrical post divided longitudinally along its length by a diametrical slot. A single-ply sheet of material forming the plurality of panels could then be strung from one support stand to the next by inserting the sheet of material into the vertically extending slots created in the posts. Other modifications of the invention are also possible. Accordingly, the scope of the invention should not be construed as limited to this specific embodiment depicted and techniques of implementation of the method described.

I claim:

1. Apparatus for visually shielding a body from view at a scene of police action comprising a plurality of free-standing shroud support stands each having a base and at least two posts extending upright from said base, a plurality of flexible, opaque, rectangular shroud panels, fastening means for releasable fastening said shroud panels to said posts, wherein said fastening means includes at least a pair of laterally separated sleeves with closed upper ends formed in each of said panels, whereby said sleeves slide onto said posts to hold said shroud panels upright between said support stands, and wherein said support stands and said shroud panels are assembled together with said support stands disposed at laterally spaced intervals about said body with said shroud panels each releasably fastened to said posts of laterally adjacent ones of said shroud support stands so as to extend therebetween.

2. A method of visually shielding a body from view at a scene of police action utilizing a plurality of shroud support stands each having a free-standing base and at least one shroud support projecting upwardly from said base, and a plurality of rectangular shroud panels formed of flexible, opaque sheet material each having mutually parallel side edges and mutually parallel top and bottom edges, comprising: forming each of said shroud support stands with a pair of mutually parallel shroud supports as aforesaid, both closely spaced relative to each other, and forming each of said shroud panels with a pair of sleeves along said side edges by forming said shroud panels from a single, elongated sheet of said opaque sheet material by folding said sheet lengthwise to form a two-layer structure and heat sealing said layers together transversely thereacross with pairs of transverse lines of heat sealing at spaced longitudinal intervals along said sheet to thereby define said sleeves as aforesaid from said single, elongated sheet between said pairs of transverse lines of heat sealing, wherein said sleeves are closed at said top edges of said shroud panels, positioning said shroud support stands about said body at laterally spaced intervals, and mounting each of said shroud panels on said shroud stands by fastening said side edges of each shroud panel onto said shroud supports on each of two laterally adjacent shroud stands by sliding said sleeves of each of said shroud panels down onto shroud supports of separate ones of said shroud support stands.

3. A method according to claim 2 further comprising transversely perforating said sheet between adjacent pairs of said transverse lines of heat sealing to thereby delineate the structure of each of said shroud panels along the length of said sheet.

* * * * *